United States Patent [19]

McKay

[11] 4,375,438

[45] Mar. 1, 1983

[54] CARBURETOR AND CIRCULAR DISCHARGE NOZZLE THEREFOR

[76] Inventor: Randolph W. McKay, 1096 Lon Verna Dr., Apt. 4, Fenton, Mo. 63026

[21] Appl. No.: 248,945

[22] Filed: Mar. 30, 1981

[51] Int. Cl.[3] ..... F02M 19/08

[52] U.S. Cl. ..... 261/23 A; 261/78 R; 261/DIG. 39; 239/567

[58] Field of Search ..... 261/DIG. 39, 78 R, 23 A; 239/567

[56] References Cited

U.S. PATENT DOCUMENTS

| | | | |
|---|---|---|---|
| 172,467 | 1/1876 | Melcher | 239/567 |
| 2,152,057 | 3/1939 | Killmeyer et al. | 261/DIG. 39 |
| 3,460,813 | 8/1969 | Hieger | 261/34 A |
| 3,606,159 | 9/1971 | Sutton | 239/566 |
| 3,664,648 | 5/1972 | Seeley, Jr. | 261/DIG. 39 |
| 3,715,108 | 2/1973 | Denton | 261/50 A |
| 4,132,752 | 1/1979 | Petermann | 261/DIG. 39 |
| 4,133,849 | 1/1979 | Hecht | 261/DIG. 39 |
| 4,171,332 | 10/1979 | Gohnert | 261/DIG. 39 |

FOREIGN PATENT DOCUMENTS

| | | | |
|---|---|---|---|
| 396593 | 6/1924 | Fed. Rep. of Germany | 261/DIG. 39 |
| 529746 | 12/1921 | France | 261/DIG. 39 |
| 9742 | 10/1923 | Netherlands | 261/DIG. 39 |
| 658305 | 4/1979 | U.S.S.R. | 261/DIG. 39 |

*Primary Examiner*—Tim R. Miles

*Attorney, Agent, or Firm*—Gravely, Lieder & Woodruff

[57] ABSTRACT

A carburetor has a main body provided with a float bowl for holding a volatile liquid fuel, at least one barrel through which combustion air flows, and a fuel supply passage leading from the float bowl to the region of the barrel, all of which is generally conventional. In addition, the carburetor is provided at the entrance to the barrel with a circular discharge nozzle for introducing the fuel into the combustion air. To this end, the nozzle is in communication with the fuel supply passage and is configured to hold a pool of the volatile liquid fuel which flows from the float bowl through the passage and into the nozzle. The nozzle contains apertures which open toward the airstream so that the pressure within the nozzle generally equalizes with that of the airstream. As a consequence, the fuel evaporates quite readily from the pool, and the vaporized fuel escapes into the airstream in sufficient quantity to produce a combustible mixture. The discharge nozzle may assume various configurations, among which are single rings, concentric rings, and disks.

13 Claims, 16 Drawing Figures

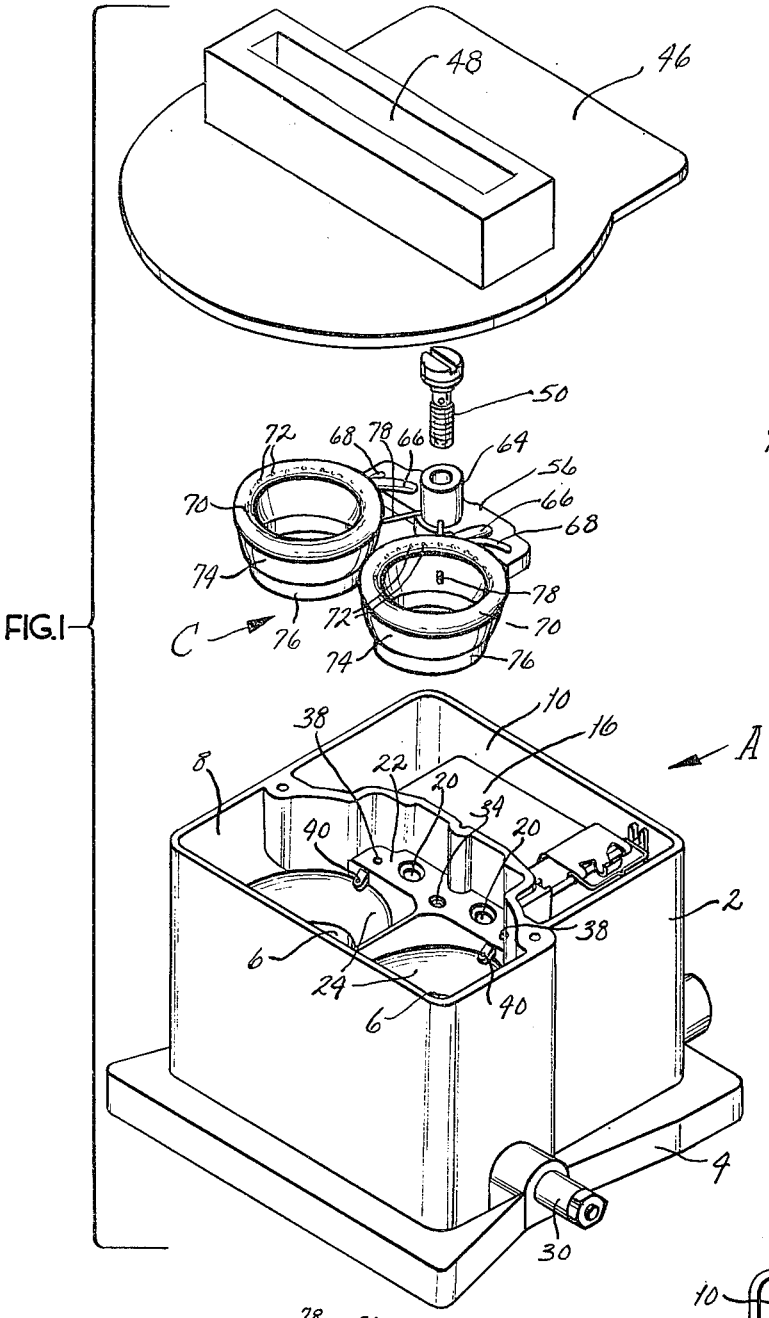
FIG.5
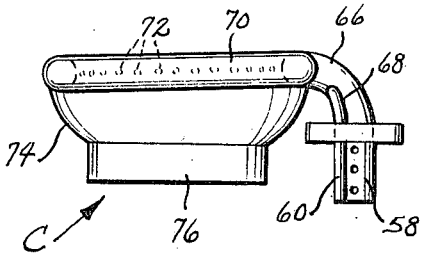
FIG.4
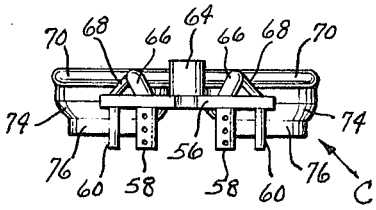
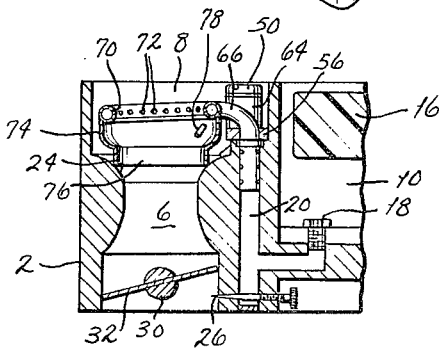
FIG. 3
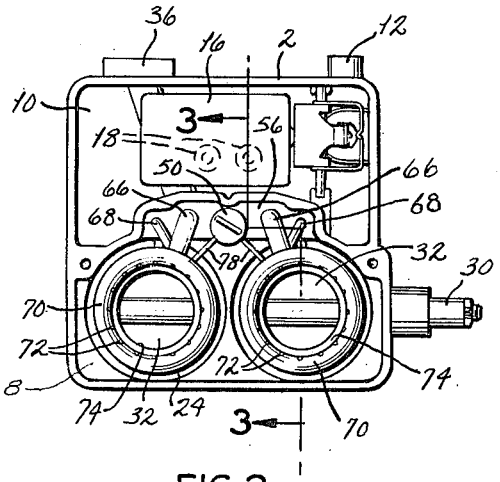
FIG. 2

CARBURETOR AND CIRCULAR DISCHARGE NOZZLE THEREFOR

BACKGROUND OF THE INVENTION

This invention relates in general to internal combustion engines powered by volatile liquid fuels and, more particularly, to carburetors for such engines.

The typical automotive engine is powered by gasoline which is mixed with air at a carburetor to produce a combustible mixture that burns within the engine to produce useful energy. Ideally, the gasoline should be a vapor, for the mixture will then burn uniformly and more completely within the cylinder. This in turn provides greater efficiency and produces less pollutants. Conventional carburetors, however, tend to atomize much of the gasoline instead of vaporizing it. As a consequence, the mixture is overly rich in gasoline, and when burned produces an excessive amount of pollutants. Furthermore, because the mixture is so rich, the engine operates inefficiently and this translates into relatively low gas mileage in the case of automobiles.

One type of carburetor that is used quite extensively on V-8 automobile engines of recent manufacture has two barrels, and at the entrance to each barrel it is provided with a booster venturi tube which is nothing more than a short tube having orifices opening out of it. These orifices in turn are connected by passageways to the carburetor float bowl. The tubes reduce the cross sectional areas through which the air flows and thereby create a venturi effect. As a consequence, gasoline is drawn out of the orifices and into the airstream where it mixes with the air to form a combustible mixture. Even so, much of the gasoline is merely atomized, and the mixture is normally excessively rich in gasoline. In some of the carburetors the venturi tubes are die cast into a cluster or single unit, and that unit in turn is bolted to the main body of the carburetor. Hence it can be removed quite easily.

Another type of carburetor, which is found primarily on six cylinder engines of recent manufacture has a single barrel that narrows down to a venturi into which a fuel discharge tube opens. This tube is connected with the float bowl of the carburetor so that fuel flows from the tube into the region of reduced pressure in the venturi. Again much of the gasoline merely remains atomized in the barrel, and the mixture that is formed is overly rich in gasoline.

SUMMARY OF THE INVENTION

One of the principal objects of the present invention is to provide a carburetor which significantly improves the efficiency of spark ignition internal combustion engines that operate on a volatile liquid fuel. Another object is to provide a carburetor of the type stated which essentially evaporates the liquid fuel from a pool of that fuel which is maintained in the region of orifices that open into the airstream, so that practically all of the fuel is vaporized. A further object is to provide a replacement for the conventional removable venturi cluster of some present carburetors to enable those carburetors to supply a leaner mixture and to vaporize more of the liquid fuel. These and other objects and advantages will become apparent hereinafter.

The present invention is embodied in a discharge nozzle for use in a carburetor as well as a carburetor containing such a nozzle. The nozzle is hollow and has apertures which open toward the airstream flowing through the carburetor, so that the hollow interior of the nozzle is at essentially the reduced pressure of the airstream. The fuel in a vaporized condition escapes from the nozzle into the airstream such that a combustible mixture is formed. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur FIG. 1 is an exploded perspective view of a carburetor provided with an improved nozzle cluster constructed in accordance with and embodying the present invention;

FIG. 2 is a plan view of the carburetor body with the nozzle cluster installed within it;

FIG. 3 is a sectional view taken along line 3—3 of FIG. 2 and showing one of the circular discharge nozzles of the nozzle cluster positioned above a barrel within the carburetor body;

FIG. 4 is a rear elevational view of the improved nozzle cluster;

FIG. 5 is a side elevational view of the nozzle cluster;

DETAILED DESCRIPTION

Figure 6:
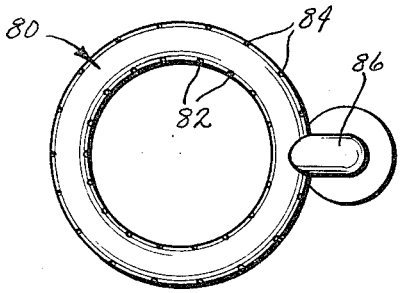
FIG. 6 is a plan view of a modified circular discharge nozzle.

Referring now to the drawings, a carburetor A (FIGS. 1–3) serves the usual purpose of mixing air and a volatile liquid fuel, gasoline in this instance, to provide a combustible mixture that is capable of powering an internal combustion engine. The carburetor A is for the most part composed of conventional components, but it is provided with a circular discharge nozzle cluster C (FIGS. 1, 4, and 5) which significantly improves the efficiency of the engine in that it converts most of the gasoline into vapor before introducing it into the airstream. The nozzle cluster C is actually a substitution for a conventional booster venturi cluster that is supplied with the carburetor, that cluster having two booster venturi discharge tubes and being easily removable as a unit from the main body of the carburetor A.

Two barrel Rochester and Motorcraft carburetors have removable venturi clusters.

Considering first the conventional components of the carburetor A, the carburetor A has a main body 2 that is an integral die casting of a suitable metal such as aluminum. It includes a flange 4 (FIG. 1) at its base, this flange being adapted for bolting the carburetor A to the intake manifold of an engine. Extending through the flange 4 are two barrels 6 which are located side-by-side within the body 2, and these barrels at their upper ends open into an air intake cavity 8 that extends the full width of the body 2. Immediately ahead of the two barrels 6 and the cavity 8 is a float bowl 10 to which a fuel line is connected at a fuel port 12. Indeed, immediately beyond the port 12 the float bowl 10 is fitted with a needle valve 14 (FIG. 2) that is operated by a float 16 which senses the level of the gasoline within the bowl 10.

At its bottom the float bowl 10 is fitted with two main metering jets 18 (FIGS. 2 and 3) through which the fuel flows at a metered rate. Beyond the jets 18 are fuel passages 20 (FIG. 2) which extend first rearwardly toward the barrels 6 and then upwardly through the wall between the barrels 6 and the float bowl 10, there being a separate passage 20 for each main jet 18. The passages 20 terminate at a shoulder 22 (FIG. 1) that is located at the bottom of the air intake cavity 8 immediately ahead of the two barrels 6.

Actually, the barrels 6 do not begin abruptly at the bottom of the air intake cavity 8, but instead commence at contoured surfaces 24 (FIG. 3) within the body 2. The surfaces 24 are somewhat convex, or toroidal, and at the lower end of each surface 24 the barrel 6 for that surface 24 has its smallest diameter, which is the normal venturi for the barrel 6. Below the venturies, the barrels 6 flare outwardly and are of cylindrical configuration within the region of the flange 4.

At the lower end of each fuel passage 20 the main body 2 has adjustable idle jets 26 (FIG. 3) which open into the barrels 6 near their lower margins. The jets 26 likewise derive fuel from the fuel passages 20.

The flange 4 of the main body serves as a bearing for a throttle shaft 30 (FIGS. 1–3) which passes through the two barrels 6 in the cylindrical regions of them. Indeed, within the barrels 6 the shaft 28 is fitted with circular throttle plates 32 (FIG. 3) which open and close the barrels 6 as the shaft 28 rotates to thereby control the amount of combustible mixture that enters the engine. The idle jets 26 are always located below the throttle plates 30.

Between the two fuel passages 20 is a pump passage 34 (FIG. 1) that likewise opens out of the shoulder 22 at its upper end. The pump passage 34 at its lower end is connected to an acceleration pump 36 (FIG. 2) which is located on the main body 2 adjacent to the float bowl 10. The pump 36 and throttle shaft 30 are connected such that when the throttle shaft 30 is rotated rapidly to bring the plates 32 upon it into or close to their fully open positions, the pump 34 will withdraw fuel from the float bowl 10 and force it through the pump passage 34. The upper end of the pump passage 34 is threaded.

In addition to the fuel passages 20 and the pump passage 34, the main body 2 in the region between the intake cavity 8 and the float bowl 10 has idle-down channels 38 (FIG. 1) which are located to the sides of the main fuel passages 20, again there being a separate idle-down channel 38 for each barrel 6. The idle-down channels 38 open into the barrels 6 above and below the venturies and serve to provide a smooth transition from high speed operation to idle. The main body 2 also has air bleed passages 40 which open into the barrels 6 at the upper rims of their contoured surfaces 24. The passages 40 communicate with the main fuel passages 20 and in a conventional carburetor enable air to mix with gasoline in the fuel passages 20 to facilitate atomization of the gasoline.

Extended across the top of the main body 2 is a cover 46 (FIG. 1) which is secured to the main body 2 by machine screws. The cover 46 completely closes the float bowl 10, but in the region of the intake cavity 8 it is provided with an opening 48 through which air is admitted to the intake cavity 8.

The foregoing components are conventional with carburetors of recent manufacture. In addition, such carburetors have a booster venturi cluster which may be secured firmly against the shoulder 22 by a hollow screw that threads down into the pump passage 34 (as illustrated), or it may be secured by solid screws that are offset from the passage 34. The conventional booster venturi cluster has two discharge tubes which are centered above the barrels 6, yet are substantially smaller in diameter. The tubes have inwardly opening apertures that are connected by means of passages within the cluster to the fuel passages 20 so that fuel flows from the passages 20 to the apertures where it enters the airstream flowing along the tubes, primarily as a mist, that is, in an atomized condition. The conventional booster venturi cluster also has two small nozzles which are located in the region between the two tubes, these nozzles being directed toward the barrels 6. The nozzles are in communication with the pump passage 34 so that when the accelerator pump 36 is actuated, raw gasoline is forced out of the nozzles and into the barrels 6.

In the improved carburetor A, the conventional booster venturi cluster is replaced with the circular discharge nozzle cluster C which provides a marked improvement in engine efficiency. The nozzle cluster C is secured in place by a machine screw 50 (FIGS. 1–3) having a hollow shank which threads into the upper end of the pump passage 34. The shank of the screw 50 has a region of reduced diameter and in this region is provided with apertures which extend into the hollow interior of the shank, so that fuel which is forced through the pump passage 34 by the acceleration pump 36 will flow through the hollow interior of the shank and be discharged through apertures within the region of reduced diameter. The screw 50 is the same screw that is used to secure a conventional booster venturi cluster to the main body 2.

The nozzle cluster C (FIGS. 1–5) includes a flat mounting bar 56 which along one of its edges is contoured to conform to the configuration of the wall that separates the air intake cavity 8 from the float bowl 10 in the main body 2. The other edge of the bar 56 is straight, except for an enlargement midway between its ends, and this edge to a large measure aligns with that edge of the shoulder 22 that extends along the entrances to the barrels 6, that is the edge which is closest to the contoured surface 24.

Extending downwardly from the bottom of the mounting bar 56 are two fuel supply tubes 58 (FIGS. 4 and 5) and two auxiliary tubes 60, the latter being located outwardly from the former. The supply tubes 58 align with and fit into the fuel passages 20 of the body 2 (FIG. 3), while the auxiliary tubes 60 align with and fit into the idle-down channels 38. The supply tubes 58 are further provided with apertures to enable fuel to flow into them not only from their ends, but through their walls as well. To prevent leakage from the ends of the passages 20 and 34, a gasket is interposed between the bottom surface of the bar 56 and the shoulder 22 of the main body 2.

Midway between its ends the mounting bar 56 is further provided with a riser 64 (FIGS. 1, 3, and 4) which projects upwardly from the upper surface of the bar 56. The riser 64 is of tubular configuration, and its hollow interior is continued through the bar 56, so that the riser 64 is in communication with the pump passage 34 of the main body 2. Indeed, the hollow screw 50 extends through the riser 54, and when threaded down into the pump passage 34, it clamps the bar 56 firmly against the shoulder 22. Even so, the hollow interior of the riser 64 is in communication with the pump passage 34 through the hollow interior of the screw 50 and the apertures within the screw 50.

In addition to the riser 64, the top surface of the mounting bar 56 also has fuel feed tubes 66 (FIGS. 1–5) which are continuations of the fuel supply tubes 58, and small end tubes 68, which are continuations of the auxiliary tubes 60. Each tube 66 and 68 corresponds with a tube 58 or 60 and is in communication with that tube 58 or 60 through the bar 56. The feed tubes 66 extend obliquely out of and over the edge of the bar 56, and the adjacent end tubes 68 likewise extend obliquely and further converge toward the adjacent feed tubes 66. Indeed, the feed and end tubes 68 and 70 on each side of the riser 64 ultimately merge, with the latter at their ends opening into the former. The feed tubes 66 project toward the axial centerlines of the two barrels 6, and slightly beyond the straight edge of the mounting bar 56 each is joined to a separate circular discharge nozzle 70.

Each circular discharge nozzle 70 (FIGS. 1–5) is of toroidal configuration, it preferably being a short length of metal tubing that is bent into a circular shape and joined together at its ends. Each nozzle 70 is secured firmly to the end of one of the feed tubes 66 that extend obliquely from the bar 56, with the arrangement being such that the nozzle 70 is centered over one of the barrels 6 in the main body 2. Even so, the nozzle 70 is not coaxial with the underlying barrel 6, but instead the axis of the nozzle 70 is canted slightly with respect to the axis of the barrel 6 so that the portion of the nozzle 70 that is located toward the rear of the main body 2 is depressed somewhat with respect to the portion that is toward the mounting bar 56 (FIG. 3). The angle of inclination for the nozzle 70 with respect to the horizontal should range between 1° and 8° preferably should be about 2°. Not only does the oblique feed tube 66 support the nozzle 70 in a slightly canted position above the barrel 6, but the tube 66 further opens into the interior of the nozzle 70 so that fuel will drain from the feed tube 66 into the hollow interior of the circular discharge nozzle 70 and create a pool of gasoline within the nozzle 70. The slight inclination of the nozzle 70 insures that the gasoline reaches the remote area of the nozzle 70 and does not collect solely in the region where the feed tube 66 centers the nozzle 70.

The circular discharge nozzle 70 furthermore has small apertures 72 which open inwardly toward the axis of the nozzle 70. In other words, the apertures 72 are on the inside surface of the circular nozzle 70, so that the pressure within the interior of the nozzle 70 essentially equalizes with that of the airstream. Moreover, the fuel escapes as a vapor through the apertures 72, and this vapor mixes with the airstream to form a combustible mixture. The apertures 72 should range between 1/32 in. and 3/32 in. in diameter and should preferably be about 1/16 in. in diameter.

Each nozzle 70 has a circular skirt 74 (FIGS. 1 and 3–5) which is attached to it and extends downwardly to the contoured surface 24 at the entrance to the underlying barrel 6. The inside diameter of the skirt 74 is slightly larger than the inside diameter of the circular discharge nozzle 70, at least where the skirt 74 is attached to the nozzle 70. However, below the nozzle 70, the skirt 74 necks inwardly and transforms into a short sleeve 76, the diameter of which is no smaller than, and perhaps slightly larger than, the inside diameter of the nozzle 70. It is along the sleeve 76 that the skirt 74 contacts the underlying contoured surface 24 (FIG. 3). In short, the sleeve 76 projects into the upper end of the barrel 6. Moreover, the diameter of the sleeve 76 is only slightly larger than the smallest diameter of the barrel 6, which is the venturi for the barrel 6.

Each skirt 74 is connected with the riser 64 by a small diameter tube 78 (FIGS. 1–3). At its upper end the interior of each tube 78 is in communication with the interior of the riser 64 in the region where the apertures open out of the hollow screw 50. Thus, when the acceleration pump 36 is activated, the fuel will flow from the riser 64 into the small tubes 78. The opposite ends of the small tubes 78 are within the skirts 74 of the nozzles 70 so that the fuel which is placed in motion by the acceleration pump 36 will flow into the skirts 74 and thence into the barrels 6 where it will mix with the air and enrichen the combustible mixture.

OPERATION

In the operation of the carburetor A, a volatile liquid fuel such as gasoline is pumped into the float bowl 10 in sufficient volume to close the needle valve 14. As the engine on which the carburetor A is mounted operates, it draws air into the carburetor A through the circular openings 48 in the cover 46. This air passes into the intake cavity 8 in the main body 2 of the carburetor A and then downwardly through the barrels 6, whereupon it enters the intake manifold for the engine. The amount of air which passes through the carburetor A depends upon the speed of the engine and the position of the throttle plates 32 within the lower ends of the barrels 6.

In any event, the air as it passes through the circular discharge nozzles 70 increases in velocity and as a result experiences a corresponding decrease in pressure. In effect, the nozzle 70 serves as another venturi that is ahead of the venturi in the underlying barrel 6. The reduced air pressure within the circular discharge nozzles 70 causes atmospheric air within the float bowl 10 to force the liquid fuel through the main metering jets 18 and upwardly through the fuel passages 20 (FIG. 3). The fuel thereupon flows into the fuel supply tubes 58 and feed tubes 66 of the nozzle cluster C. The feed tubes 66 discharge the fuel into the nozzles 70 where it collects in shallow pools of annular configuration. Within each nozzle 70 the pool extends around the entire nozzle 70 and is perhaps at a slightly greater depth at the depressed portion of the nozzle 70. Since the interiors of the nozzles 70 are at a reduced pressure by reason of the increased velocity of the air flowing through them, the liquid fuel evaporates quite readily from the surfaces of the two pools and escapes from the nozzles 70 through the apertures 72 which are presented inwardly toward the flowing air. In other words, the fuel vaporizes within the nozzles 70 and leaves the nozzles 70 as a vapor which enters the airstreams.

The vaporized fuel mixes with the air in the airstream, and the surface area of the two pools as well as the number and size of the apertures 72 are all such that the fuel-air mixture which is produced is adequately proportioned to support combustion within the cylinders of the engine. Even so, the mixture contains little if any atomized fuel and is further not excessively rich in fuel. In short, the proportions are correct for supporting combustion in its most efficient manner, so that the products of combustion contain comparatively few pollutants. Furthermore, maximum energy is derived from the fuel.

It has been established by actual tests with an automotive vehicle having an engine displacing 351 $in^3$, that the vehicle will obtain about 4 miles per gallon more when the carburetor A is equipped with the cluster C instead of a conventional booster tube venturi cluster of the type that is normally supplied with the carburetor A.

If the throttle shaft 30 is rotated rapidly to its position in which the throttle plates 32 align generally with the axis of the barrels 6, the acceleration pump 36 will force the liquid fuel through the pump passage 34 and into the hollow interior of the machine screw 50 that holds the venturi cluster C in place. The pump 36 further forces the fuel through the apertures within the screw 50 and into the interior of the riser 64, whereupon the fuel passes into the small diameter connecting tubes 78 that discharge into the circular skirts 74 below the circular discharge nozzles 70. The raw gasoline enters the airstream along with the fuel vapor derived from the nozzles 70 and enrichens the mixture sufficiently to prevent the engine from stalling under a sudden increase in demand for power.

When the engine operates at idle, very little fuel enters the airstream through the circular discharge nozzle 70. On the contrary, most of the fuel enters through the idle jets 26 which are located below the throttle plates 32 and are supplied with fuel through the fuel passage 20.

The circular discharge nozzle cluster C may be supplied as a replacement component for the normal booster tube venturi cluster found in some carburetors, that is those carburetors which have detachable booster venturi clusters. As such, the normal venturi cluster is easily removed merely by unscrewing the machine screw 50 and pulling the venturi cluster upwardly out of the air intake cavity 8 of the main body 2 for the carburetor. Then the nozzle cluster C is installed in its place merely by aligning the fuel supply tubes 58 and the auxiliary tubes 60 with the fuel passages 20 and the idle-down channels 38 in the main body 2 and allowing the cluster C to drop downwardly until its mounting bar 56 seats against shoulder 22 in the main body 2. Finally, the hollow screw 50 is replaced to fasten the nozzle cluster C in place with its circular discharge nozzles 70 centered above the barrels 6. Of course, the nozzle cluster C may be held in place other than by the hollow machine screw 50, such as by machine screws which are offset from the pump passage 34, and in that case those screws are turned down to hold the cluster C secure.

MODIFICATIONS

The venturi cluster C is designed specifically for a two barrel carburetor having a removable booster venturi cluster. By making minor alterations, it is possible to adapt the principles of the venturi cluster C to other types of carburetors, including single barrel carburetors as well as other multiple barrel carburetors. Also, the nozzle cluster C need not be a separate or replaceable component, but instead can be integral with the main body of the carburetor. Furthermore, the circular discharge nozzle may assume other configurations.

Figure 7:
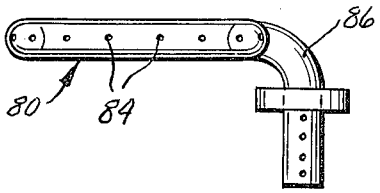
FIG. 7 is an elevational view of the discharge nozzle illustrated in FIG. 6.

For example, a modified circular discharge nozzle 80 (FIGS. 6 and 7) is very similar to the nozzle 70 except that it is provided with apertures 82 which open inwardly toward the axis of the nozzle 80 and in addition apertures 84 which open outwardly away from the axis. The nozzle 80 is supported on and supplied with fuel through a feed tube 86, and the fuel collects in the nozzle 80, forming a circular pool therein. The nozzle 80 does not have a skirt since it is desirable to have the air flow both through its center and past its outwardly presented surface so that the vapor will escape through the inner apertures 82 as well as the outer apertures 84.

Figure 8:
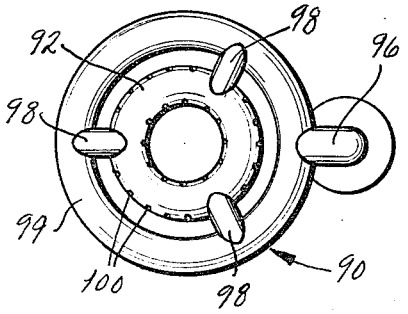
FIG. 8 is a plan view of another modified circular discharge nozzle.
Figure 9:
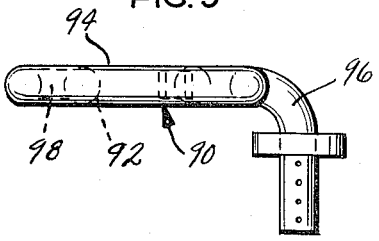
FIG. 9 is an elevational view of the discharge nozzle illustrated in FIG. 8.

Still another discharge nozzle 90 (FIGS. 8 and 9) has inner and outer concentric rings 92 and 94, respectively, with the inner ring 92 being supported by the outer ring 94. In this regard, the outer ring 94 is supported on a feed tube 96 such that the liquid fuel flows into the outer ring 94. The inner ring 92, in turn, is supported on the outer ring 94 by short connecting tubes 98 which extend radially, and these tubes provide communication between the interiors of the two rings 92 and 94 so that the fuel in the outer ring 94 will flow into the inner ring 92. The inner ring 92 has both inwardly opening and outwardly opening apertures 100. The two rings 92 and 94 provide an exceptionally large surface area from which the fuel may evaporate and furthermore tend to restrict the size of the air channel for a very short distance so that an exceedingly high air velocity develops in the region of the nozzle 90. This creates an extremely low pressure which greatly enhances the evaporation of fuel from the two concentric pools within the nozzle 90. The nozzle 90 may be fitted with a skirt similar to the skirt 74 of the nozzle 70.

Figure 10:
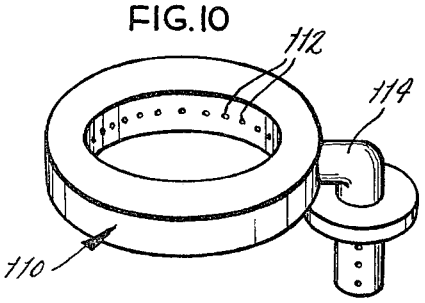
FIG. 10 is a perspective view of still another modified circular discharge nozzle.

Still another discharge nozzle 100 (FIG. 10) is very similar to the nozzle 70 except that the tubing from which it is formed is of rectangular cross-sectional configuration. The inwardly presented wall of this nozzle 110 is provided with apertures 112 and the outwardly presented wall may or may not be provided with apertures. In either case, the rectangular cross-sectional configuration affords a somewhat larger pool in which the liquid fuel collects, this fuel entering the nozzle 110 through a feed tube 114. The nozzle 110 may be fitted with a skirt similar to the skirt 74 of the nozzle 70.

Figure 11:
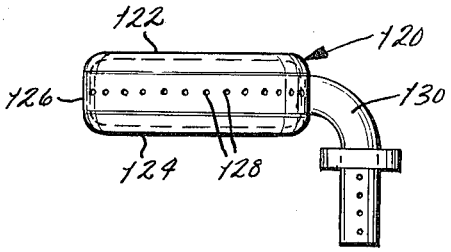
FIG. 11 is an elevational view of yet another modified circular discharge nozzle.

Yet another modified nozzle 120 (FIG. 11) provides even a larger surface area from which the fuel may evaporate. The nozzle 120 consists of a hollow disk having spaced apart top and bottom walls 122 and 124 and a peripheral wall 126 which joins the walls 122 and 124. The peripheral wall 126 has apertures 128 that are located above the bottom wall 122 so that a pool of liquid fuel will collect in the nozzle 120, this fuel being supplied through a feed tube 130 that connects with the peripheral wall 126. All of the air flows around the outside of the nozzle 120, and as a result the pressure decreases within the interior of the nozzle 120, causing the fuel to evaporate and escape through the apertures 128 as a vapor that enters the airstream.

Figure 12:
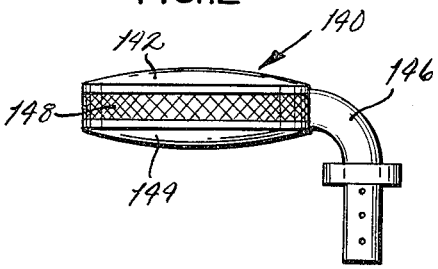
FIG. 12 is an elevational view of another modified circular discharge nozzle.

Another nozzle 140 (FIG. 12) is in essence a variation of the nozzle 120 in that it is disk-shaped and provides a large pool from which the fuel vapor is derived. In this regard, the discharge nozzle 120 comprises two saucer-shaped disks 142 and 144 which are convex on their outer surfaces and are connected to a feed tube 146 such that the tube 126 discharges into the space between the two disks 142 and 144. This enables a pool of liquid fuel to collect on the lower disk 124. Around the periphery of the two disks 122 and 124 in the space between them is a fine mesh screen 148 for breaking up any droplets that may otherwise escape.

Figure 13:
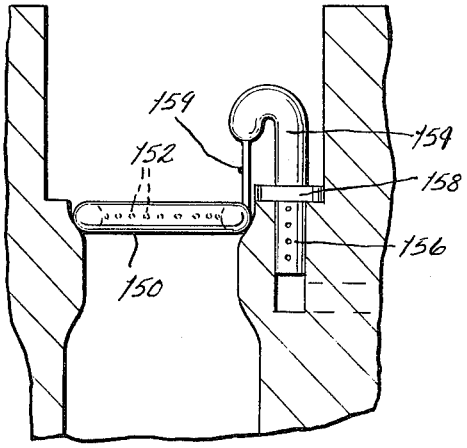
FIG. 13 is a sectional view of a carburetor body provided with another modified discharge nozzle.

A somewhat different circular discharge nozzle 150 (FIG. 13) is fitted against contoured surfaces 24 of the carburetor barrel 6 immediately ahead of the normal venturi to form another venturi somewhat upstream in the carburetor. The nozzle 150 has inwardly opening apertures 152 and is supplied with fuel through a feed tube 154 that forms a continuation of a fuel supply tube 156, the latter being separated from the former by a mounting bar 158. The feed tube 154 extends upwardly and then turns downwardly with the downwardly extended portion containing a constriction 159 to prevent an excessive amount of fuel from flowing into the nozzle 150.

Figure 14:
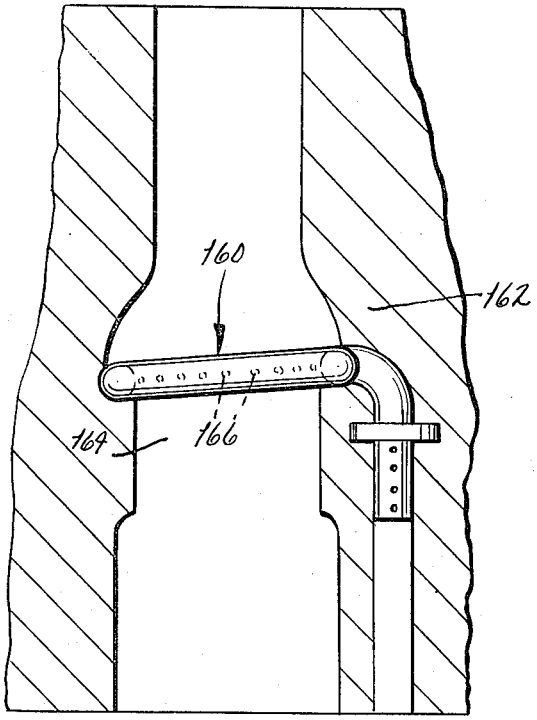
FIG. 14 is a sectional view of a carburetor body having a circular discharge nozzle of the present invention embodied in it as an integral component.

Instead of having a separate circular discharge nozzle, a circular discharge nozzle 160 (FIG. 14) may be embodied within the main body 162 of the carburetor immediately ahead of the venturi in the carburetor barrel 164 of the carburetor. The nozzle has apertures 166 which open inwardly toward the airstream that flows through the carburetor. This arrangement permits heat to be conducted from the engine to the fuel within the circular discharge nozzle 160, and this of course facilitates the evaporation of the fuel from the surface of the pool within the nozzle 160. In this arrangement the barrel 164 of the carburetor is somewhat smaller upstream from the nozzle 160 than below the nozzle 160 and the inside diameter of the nozzle 160 corresponds closely to the inside diameter of the lower portion of the barrel 164.

Figure 15:
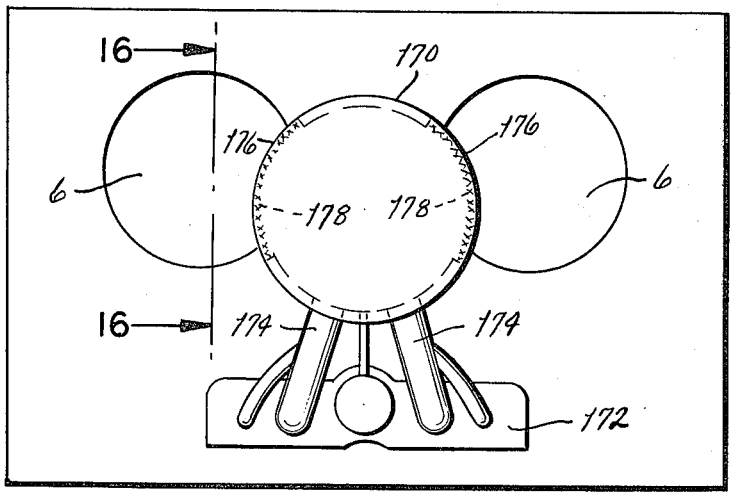
FIG. 15 is a plan view of the body of a two barrel carburetor having a single circular discharge nozzle serving both barrels of the carburetor.
Figure 16:
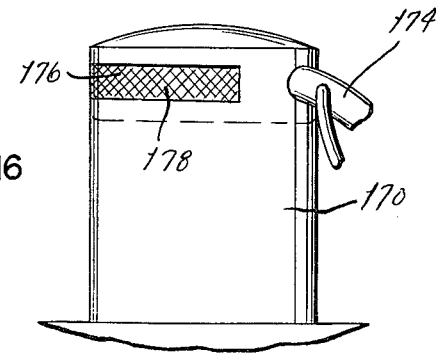
FIG. 16 is an elevational view of the circular discharge nozzle taken along line 16—16 of FIG. 15.

In a variation of the concept, only a single nozzle 170 (FIGS. 15 and 16) is used between two barrels 6 of a double barrel carburetor. This nozzle 170 is tubular and is disposed within the air cavity 8 between the two barrels 6 of the carburetor. The nozzle 170 is supported on a mounting bar 172 by feed tubes 174 which are connected between the interior of the nozzle 170 and the bar 172, those tubes being also in communication with the fuel supply passages 20 in the main body 2 of the carburetor. The nozzle 170 is large enough to project over a portion of each of the barrels 6 and within these projecting portions the nozzle 170 is provided with slits 176 that have a fine mesh screen 178 extended over them. A pool of liquid fuel collects within the nozzle 170 where it evaporates and passes out of the tubular member through the screen 178 along the sides of the nozzle 170.

For the foregoing it is apparent that the nozzles of the present invention may be supplied in kit form or they may be incorporated in actual carburetors as integral parts thereof.

In the case of single barrel carburetors of the type often used on six cylinder engines, the feed tube of the circular discharge nozzle may be configured to fit into the bowl vent for such a carburetor. This vent is a simple tube which extends from the upper end of the float bowl into the barrel above the throat in which the main discharge nozzle is located, and as such the bowl vent normally equalizes the pressure between the float bowl and the upper portion of the throat. In any event, the bowl vent supports the circular discharge nozzle in the barrel of the carburetor and allows the vaporized fuel derived from the float bowl to enter the throat and mix with the air passing through the throat. In such an arrangement the normal jet, the discharge nozzle, and the booster venturi serve no purpose and are not necessary.

The optimum diameter of the circular discharge nozzle is $1\frac{1}{4}$ to $1\frac{1}{2}$ inches, depending on the size of the carburetor barrel.

This invention is intended to cover all changes and modifications of the example of the invention herein chosen for purposes of the disclosure which do not constitute departures from the spirit and scope of the invention.

What is claimed is:

1. In combination with a carburetor having a main body provided with a reservoir for containing a volatile liquid fuel, at least one barrel surrounded by a surface which converges and then diverges to create a venturi in the barrel, a cavity located ahead of the barrel, a fuel passage leading from the reservoir to the region of the cavity, and means within the barrel downstream from the venturi thereof for controlling the amount of air that passes through the barrel, the improvement comprising: a hollow ring located in the cavity ahead of the barrel so that air before entering the barrel passes by the ring, the ring having openings that expose the hollow interior of the ring to the intake cavity so that the interior of the ring assumes a pressure close to that of air passing through the ring, the openings further being located above the bottom of the ring to enable liquid fuel to collect within the ring in a pool; and a feed tube connecting the interior of the ring with the fuel passage so that liquid fuel flows from the reservoir to the interior of the ring and produces a pool within the ring; the interior diameter of the ring being at least substantially as large as the diameter of the throat of said venturi, and the diameter and number of the apertures within it being such that air passing through the ring during operation of the carburetor causes the fuel to evaporate from the pool within the ring and escape into the air substantially as a vapor and in sufficient quantity to produce a combustible mixture of fuel and air within the barrel.

2. The combination according to claim 1 wherein the air flows generally vertically through the ring-like nozzle; and the nozzle is inclined slightly with respect to the horizontal such that the portion of it into which the feed tube empties is located slightly higher than the portion of it that is remote from the feed tube.

3. The combination according to claim 1 wherein the main body has a pump passage which extends to an acceleration pump which forces liquid fuel derived from the reservoir through the pump passage when the means for controlling the amount of air is suddenly opened to allow a large flow of air through the barrel; and wherein the improvement further comprises a short tube which at one end communicates with the pump passage and has its other end directed to the barrel for directing liquid fuel into the barrel.

4. The combination according to claim 1 wherein the axis of the ring is canted alightly with respect to the axis of the barrel, the angle between the two axes being between about 1° and 8°.

5. The combination according to claim 1 wherein the inside diameter of the ring is slightly larger than the smallest diameter of the barrel.

6. The combination according to claim 1 and further comprising a circular skirt attached to the ring and extended to generally the converging surface of the barrel so that substantially all of the air that passes into the barrel flows through the ring-like nozzle; and wherein the apertures open inwardly toward the center of the nozzle.

7. The combination according to claim 6 wherein the upper end of the skirt is larger in diameter than the lower end.

8. The combination according to claim 7 wherein each feed tube supports the ring to which it is connected such that the portion of the ring that is remote from the feed tube is slightly lower than the portion into which the feed tube opens.

9. The combination according to claim 1 and further comprising a mounting element to which the feed tube is attached, and wherein the mounting element is secured to the main body such that the feed tube communicates with the fuel passage in the main body.

10. The combination according to claim 9 wherein the main body has a horizontal shoulder and the mounting element is secured to the shoulder.

11. The combination according to claim 10 and further comprising a fuel supply tube extended from the mounting element in generally the opposite direction from the feed tube, the fuel supply tube being extended into the fuel supply passage of the main body and further having its interior in communication with the interior of the feed tube.

12. The combination with a carburetor body having a reservoir for containing a volatile liquid fuel, two barrels located side-by-side with each being defined by a converging and diverging surface which creates a venturi within the barrel, a common air intake cavity located upstream from and opening into both barrels, a mounting surface located at the cavity and being designed for supporting a booster venturi cluster, and fuel passages extending from the reservoir to the mounting surface, a circular discharge nozzle cluster positioned on the mounting surface in lieu of a booster venturi cluster, said cluster comprising: a mounting bar secured against the mounting surface; feed tubes extended from the mounting bar into the cavity, the tubes being in communication with the feed passages of the carburetor body through the mounting bar; circular discharge nozzle rings attached to the feed tubes and supported within the cavity by the feed tubes such that they are positioned ahead of and generally in axial alignment with the barrels, each nozzle ring being circular and tubular and having apertures located above the bottom thereof so that liquid fuel from the feed tube with which it is connected will collect within the nozzle ring to form a pool, the interior diameter of the nozzle rings being at least substantially as large as the diameters of the throats of said venturies, and the diameter and number of the apertures within the rings being such that air passing through the rings and into the barrels during normal operation of the carburetor will cause the liquid fuel within the pools to evaporate and escape into the air substantially as a vapor and in sufficient quantity to create a combustible mixture within the barrels.

13. A combination according to claim 12 wherein the apertures in the circular nozzle rings open inwardly toward the axes of the rings; and further comprising a skirt attached to each ring and extended to generally generally the converging surface of the barrel with which the ring is aligned, whereby substantially all of the air that passes into the barrel passes through the ring.

* * * * *